US010939740B2

(12) United States Patent
Cheng et al.

(10) Patent No.: US 10,939,740 B2
(45) Date of Patent: Mar. 9, 2021

(54) SYSTEM FOR METERING IN A ROLLER BALL APPLICATOR

(71) Applicant: L'OREAL, Paris (FR)

(72) Inventors: Wenzhen Cheng, Annandale, NJ (US); Blake Soeters, Middletown, NJ (US); Rodney Hough, Mountainside, NJ (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/236,930

(22) Filed: Dec. 31, 2018

(65) Prior Publication Data

US 2020/0205547 A1 Jul. 2, 2020

(51) Int. Cl.

| | |
|---|---|
| ***B43K 7/00*** | (2006.01) |
| ***A45D 34/04*** | (2006.01) |
| ***A45D 40/26*** | (2006.01) |

(52) U.S. Cl.

CPC ..... *A45D 34/041* (2013.01); *A45D 40/261* (2013.01); *A45D 2200/055* (2013.01)

(58) Field of Classification Search

CPC ..... A45D 34/041; A45D 40/261; A45D 2200/054; A45D 2200/055

USPC ..... 401/176, 209, 213

See application file for complete search history.

(56) References Cited

U.S. PATENT DOCUMENTS

| | | | | |
|---|---|---|---|---|
| 6,533,482 | B1 * | 3/2003 | Byun | A45D 34/04 401/180 |
| 7,497,635 | B1 * | 3/2009 | Bae | A45D 34/04 401/188 R |
| 8,079,388 | B2 | 12/2011 | Turgeman | |
| 8,921,746 | B2 * | 12/2014 | Baarman | A45D 40/261 219/660 |
| 9,161,605 | B2 * | 10/2015 | Kim | B05B 11/3052 |
| 9,248,462 | B2 * | 2/2016 | Csaszar | B05B 11/0008 |
| 10,334,933 | B2 * | 7/2019 | Decaux | A45D 40/261 |
| 2003/0068185 | A1 * | 4/2003 | Silverbrook | B41J 2/155 400/613 |
| 2010/0237033 | A1 | 9/2010 | Windmiller | |
| 2013/0068796 | A1 | 3/2013 | Hui et al. | |

(Continued)

FOREIGN PATENT DOCUMENTS

| | | |
|---|---|---|
| DE | 20 2013 004 144 U1 | 6/2014 |
| FR | 2 836 345 A1 | 8/2003 |

(Continued)

OTHER PUBLICATIONS

International Search Report and Written Opinion of the International Searching Authority dated Mar. 20, 2020 in PCT/US2019/068582, 14 pages.

*Primary Examiner* — Jennifer C Chiang

(74) *Attorney, Agent, or Firm* — Oblon, McClelland, Maier & Neustadt, L.L.P.

(57) ABSTRACT

A system for regulating application of solution to a user, includes a rollerball; a body, including a first end and a reservoir disposed at a second end of the body; a fitment, including a well and a solution regulator; and a piston, wherein the fitment is configured to hold the rollerball; the rollerball is substantially spherical and rotatable in the fitment; the first end of the body is configured to hold the fitment; the reservoir is configured to hold a solution; the piston is inserted into the reservoir at the second end of the body; and the well is configured to receive a predetermined volume of the solution from the reservoir.

13 Claims, 4 Drawing Sheets

(56) References Cited

U.S. PATENT DOCUMENTS

| | | | | |
|---|---|---|---|---|
| 2013/0158547 | A1 | 6/2013 | David | |
| 2015/0360014 | A1 | 12/2015 | Decaux et al. | |
| 2016/0015150 | A1 | 1/2016 | Casasanta, III | |
| 2019/0116959 | A1* | 4/2019 | Byun | A45D 40/00 |
| 2019/0255305 | A1* | 8/2019 | Hendriks | A61K 8/36 |

FOREIGN PATENT DOCUMENTS

| | | | |
|---|---|---|---|
| FR | 3 002 148 | A1 | 8/2014 |
| JP | 4121588 | B2 | 7/2008 |
| WO | WO 2010/076912 | A1 | 7/2010 |
| WO | WO 2014/096313 | A1 | 6/2014 |
| WO | WO 2016/033202 | A1 | 3/2016 |

* cited by examiner

SYSTEM FOR METERING IN A ROLLER BALL APPLICATOR

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Applying a liquid, oil, or higher viscosity solution to a user's skin via a rollerball device may have applications in the fields of cosmetics, dermatology, myriad skin therapies, etc. As described in U.S. PG Publication No 2015/0360014A (incorporated herein by reference), solution in an interior of a reservoir may be in contact with a side of a rollerball facing the reservoir. As the rollerball is rolled along the skin of a user, the solution in the reservoir is transferred via the rollerball rotation to an exterior side of the rollerball in contact with the user's skin. Thus, the device facilitates a consistent application of solution over an area. This is especially advantageous when solutions containing medicine are applied to the skin and application via a user's hands may absorb a portion of the medicated solution. This may result in insufficient application of the recommended applied dosage. Furthermore, a user may attempt to compensate for this effect and apply more than the recommended dosage, resulting in inconsistent or over dosage. Accordingly, systems of dispensing metered quantities of solution are desired.

SUMMARY

The present disclosure relates to a system for regulating application of solution to a user, including a rollerball; a body, including a first end and a reservoir disposed at a second end of the body; a fitment, including a well and a solution regulator, and a piston, wherein the fitment is configured to hold the rollerball; the rollerball is substantially spherical and rotatable in the fitment; the first end of the body is configured to hold the fitment; the reservoir is configured to hold a solution; the piston is inserted into the reservoir at the second end of the body; and the well is configured to receive a predetermined volume of the solution from the reservoir.

In one aspect, the solution regulator includes a check valve; the check valve is configured to allow transfer of the solution from the reservoir to the well in response to an applied force from a direction of the reservoir; and the check valve is configured to prevent leakage of the solution from the well to the reservoir.

In one aspect, the solution regulator includes at least one hole; the solution is a high viscosity solution; and the at least one hole is configured to allow transfer of the predetermined volume of solution from the reservoir to the well.

The foregoing paragraphs have been provided by way of general introduction, and are not intended to limit the scope of the following claims. The described aspects, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The description set forth below in connection with the appended drawings is intended as a description of various aspects of the disclosed subject matter and is not necessarily intended to represent the only aspect(s). In certain instances, the description includes specific details for the purpose of providing an understanding of the disclosed subject matter. However, it will be apparent to those skilled in the art that aspects may be practiced without these specific details. In some instances, well-known structures and components may be shown in block diagram form in order to avoid obscuring the concepts of the disclosed subject matter.

Reference throughout the specification to "one aspect" or "an aspect" means that a particular feature, structure, characteristic, operation, or function described in connection with an aspect is included in at least one aspect of the disclosed subject matter. Thus, any appearance of the phrases "in one aspect" or "in an aspect" in the specification is not necessarily referring to the same aspect. Further, the particular features, structures, characteristics, operations, or functions may be combined in any suitable manner in one or more aspects. Further, it is intended that aspects of the disclosed subject matter can and do cover modifications and variations of the described aspects.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear," "side," "interior," "exterior," and the like that may be used herein, merely describe points of reference and do not necessarily limit aspects of the disclosed subject matter to any particular orientation or configuration. Furthermore, terms such as "first," "second," "third," etc., merely identify one of a number of portions, components, points of reference, operations and/or functions as described herein, and likewise do not necessarily limit aspects of the disclosed subject matter to any particular configuration or orientation.

Figure 1:
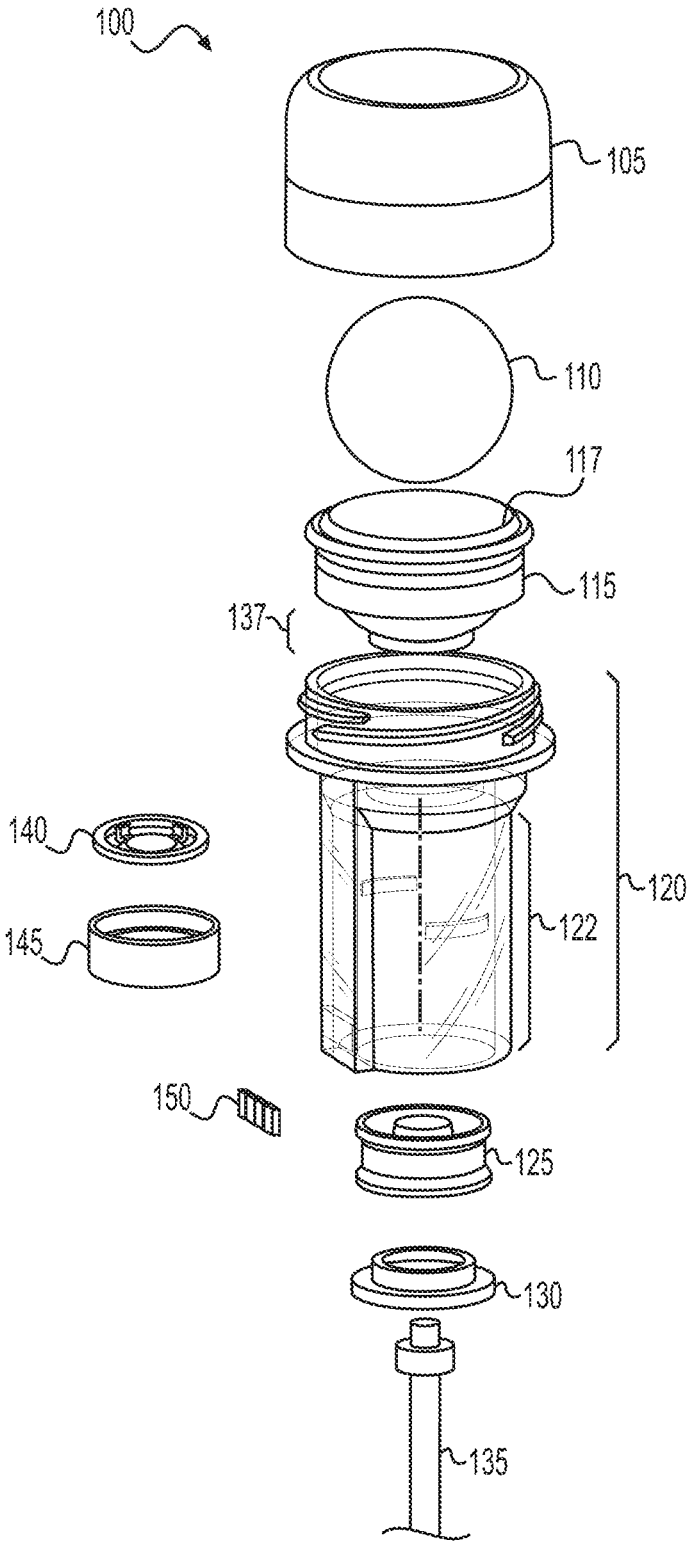
FIG. 1 is a perspective view schematic of a capsule, according to an exemplary aspect of the present disclosure.

FIG. 1 illustrates a perspective view schematic of a capsule 100, according to an exemplary aspect of the present disclosure. The capsule 100 may include a cap 105, a rollerball 110, a fitment 115, a body 120, a piston 125, a plug 130, a push rod 135, and an authentication chip 150.

In one aspect, the cap 105 may be disposed at a first end of the body 120 and configured to attach to the body 120. For example, the cap 105 may be threaded and twist tightened onto the body 120 which may also be threaded (as shown) or the cap 105 may be snap tightened onto the body 120. The fitment 115 may be disposed at the first end of the body 120.

The cap 105, fitment 115, body 120, piston 125, and plug 130 may be fabricated from a polymer material. Non-limiting examples of materials for the cap 105, fitment 115, body 120, piston 125, and plug 130 (either separately or together) include at least one of a thermoplastic elastomer, polypropylene (PP), polyethylene terephthalate (PETG), acrylonitrile butadiene styrene (ABS), polycarbonate (PC), polyamide (Nylon), polystyrene (PS), low-density polyethylene (LDPE), and high-density polyethylene (HDPE), or any combination thereof. For example, all pieces may be fabricated from PP. In another example, the cap 105 may be fabricated from PP, the fitment 115 may be fabricated from PETG, the body 120 may be fabricated from PP, the piston 125 may be fabricated from LDPE, and the plug 130 may be fabricated from PP.

The body 120 may be shaped substantially cylindrical and include a first opening at the first end and a reservoir 122 at a second end, wherein an inner diameter of the first opening is wider than an inner diameter of the reservoir 122. Both the first opening and reservoir 122 may be substantially annular. The first opening of the body 120 may include a length of substantially straight stroke having the inner diameter of the first opening. The first opening may taper more narrowly down to the inner diameter of the reservoir 122. The reservoir 122 may be substantially straight and connected to the tapered portion extending from the first length of substantially straight stroke. It may be appreciated that the cross-sectional shape of the body 120 may be fabricated as myriad other shapes, for example triangular, square, pentagonal, hexagonal, octagonal, or the like.

The first opening may be configured to hold the fitment 115. The fitment 115 may include an exterior shape that is configured to be push-fit into the first opening, wherein the fitment 115 shape may contour to the length of substantially straight stroke and the tapered portion extending from the length of substantially straight stroke. Thus, the fitment 115 may form a liquid-tight seal with the first end of the body 120. In another aspect, the fitment 115 may be fabricated as part of the body 120 at the first end of the body 120. For example, the fitment 115 and body 120 may be molded together as one piece. The fitment 115 may be configured to hold the rollerball 110, wherein an interior shape of the fitment 115 is substantially hemispherical. A first end of the fitment 115 may include a rollerball retainer 117. The rollerball retainer 117 may be an annular extrusion of material from the first end of the fitment 115 that may slightly taper inwards towards the interior of the fitment 115 such that the inner diameter of the rollerball retainer 117 is narrower than the diameter of the rollerball 110. The rollerball 110 may be installed in the fitment 115 by pushing the rollerball 110 through the opening of the rollerball retainer 117. The rollerball retainer 117 may elastically deform outwards (i.e. the rollerball retainer 117 opening widens and may thus be fabricated from a deformable polymer) to accommodate the rollerball 110 when the rollerball 110 is pushed through and then return to its original inner diameter. The rollerball 110 may be fabricated from glass, metal, or a polymer, such as the ones described for the cap 105, fitment 115, body 120, piston 125, and plug 130.

The piston 125 and plug 130 may be disposed at the second end of the body 120. The piston 125 may be shaped substantially disc-like and may include an outer diameter equal to, or marginally narrower than, the inner diameter of the reservoir 122 such that a liquid-tight seal may be formed between the piston 125 and an interior of the reservoir 122. The plug 130 may also be shaped substantially disc-like. The piston 125 may be installed in the reservoir 122 and the plug 130 may be installed at the second end of the body 120, wherein the plug 130 prevents egress of the piston 125. The plug 130 may be push-fit, snap-fit, twist-tightened, or chemically attached to the second end of the body 120. The plug 130 may include a hole in the middle configured to allow the push rod 135 to reversibly travel through. In another aspect, the plug 130 may be fabricated as a part of the body 120 at the second end of the body 120. For example, the plug 130 and body 120 may be molded together as one piece. It may be appreciated that the piston 125 and plug 130 may be shaped according to the cross-sectional shape of the body 120, and the disc-like shape is just one example.

A first end of the push rod 135 may be configured to abut the piston 125. For example, the piston 125 may include a molded indentation opening towards the second end of the body 120 having a shape complementary to the first end of the push rod 135. A second end of the push rod 135 (not shown) may be attached to a metering device (not shown) configured to translate the push rod 135 a predetermined distance. The metering device may take the form of the applicator described in the background, and as understood in the art, such an applicator would be configured to receive the capsule of the present embodiments. The abutting of the first end of the push rod 135 against the piston 125 therefore causes the piston 125 to travel towards the first end of the body (i.e. into the reservoir 122) the same predetermined distance the push rod 135 is translated.

The reservoir 122 may be configured to hold a solution. In one aspect, the solution may be a cosmetic. Non-limiting examples include at least one of lip gloss, eye shadow, foundation, concealer, eyebrow liner, nail polish, and blush, or any combination thereof.

In one aspect, the solution may be a topical medication. Non-limiting examples include at least one of a serum, an ointment, a lotion, oil, an essential oil, a serum, a cream, a gel, a paste, foam, a water-based mixture, and an alcohol-based mixture (e.g. a tincture), or any combination thereof. The topical medication may include active ingredients, such as drug content, for treating skin ailments. In another aspect, the topical medication may include nutrients, for example vitamins and minerals.

Figure 2:
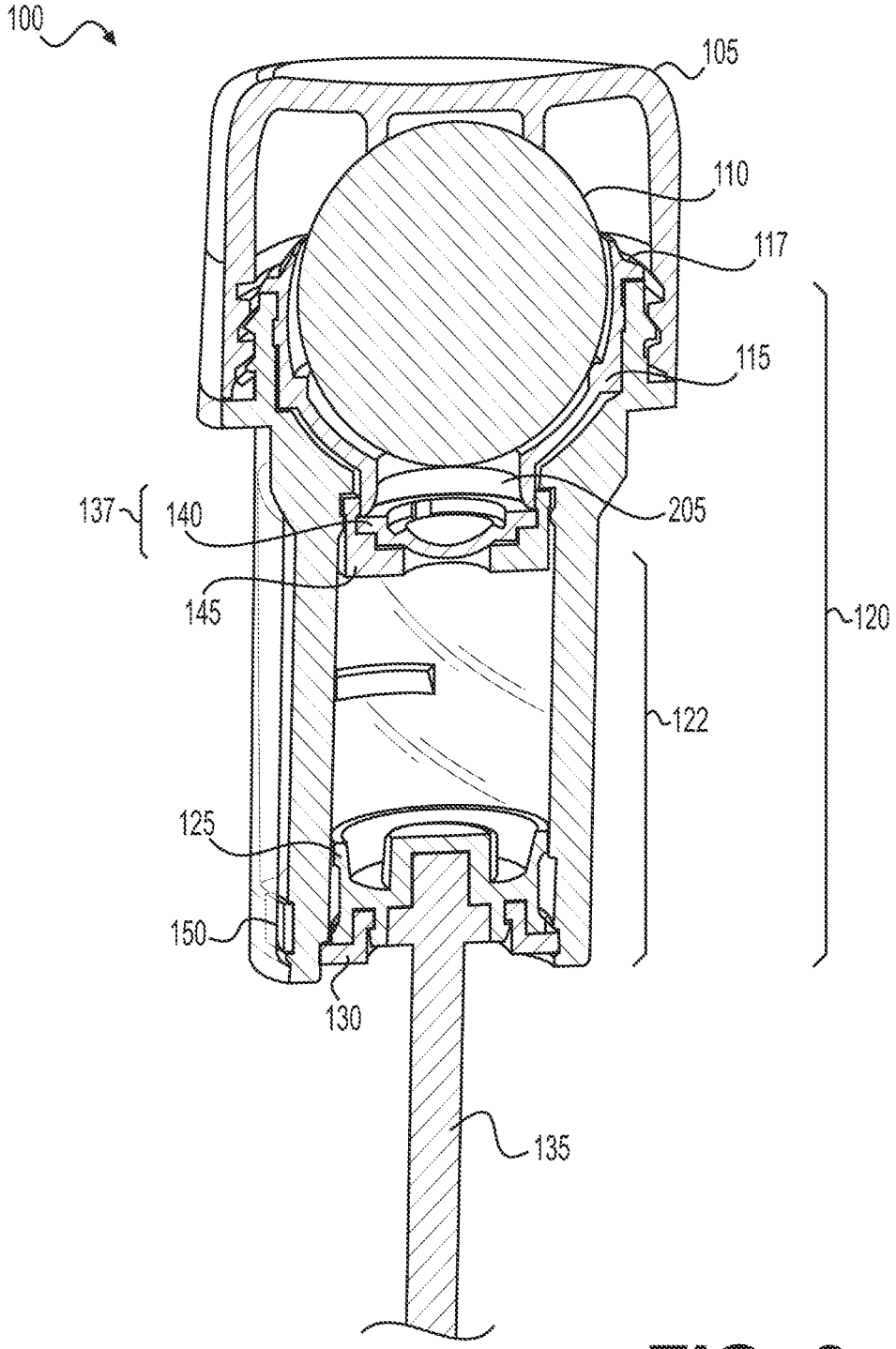
FIG. 2 is a cross-sectional view schematic of a capsule, according to an exemplary aspect of the present disclosure.

FIG. 2 illustrates a cross-sectional view schematic of the capsule 100, according to an exemplary aspect of the present disclosure. The fitment 115 may include a well 205. The 205 well may be the volume between the rollerball 110 and the interior of the fitment 115. The well 205 may be configured to receive a predetermined volume of solution from the reservoir 122. The fitment 115 may include a solution regulator 137 disposed at a second end of the fitment 115 through which the predetermined volume of solution is transferred from the reservoir 122 to the well 205. The solution regulator 137 may be an orifice or a partially open orifice through which the solution flows towards the well 205, wherein the solution regulator 137 may be configured to meter the predetermined volume of solution passing through and preventing undesired reverse flow of solution from the well 205 towards the reservoir 122.

In one aspect, the solution regulator 137 may be provided by a check valve 140. The solution regulator 137 may be substantially open and configured to allow attachment or insertion of the check valve 140. The check valve 140 may be installed inside or proximal to the second end of the fitment 115 and held in place via a check valve holder 145. The check valve 140 and check valve holder 145 may be installed in the reservoir 122 through the second end of the body 120. For example, the check valve 140 may be installed first and the check valve holder 145 may be installed after, wherein the check valve holder 145 includes features that allow it to be snap fit into complementary features of the reservoir 122. In another non-limiting example, the check valve 140 may be coupled to the check valve holder 145 prior to installation of both into the reservoir 122. In another non-limiting example, the check valve 140 and check valve holder 145 may be chemically bonded to the reservoir 122 by, for example, glue, epoxy, caulking, or any combination thereof. In another aspect, the check valve 140 and check valve holder 145 may be fabricated as a single part, i.e. the check valve 140 includes features that allow it to be snap fit into the complementary features of the reservoir without requiring the separate check valve holder 145. Non-limiting examples of materials for the check valve holder 145 include at least one of a thermoplastic elastomer, PP, PETG, ABS, PC, Nylon, PS, LDPE, and HDPE, or any combination thereof.

In one aspect, the check valve 140 may be a one-way valve allowing solution transfer in a single direction of flow (or preventing solution transfer in said direction of flow when flow stoppage is desired). The check valve 140 may be a deformable membrane held in position via tension, wherein the position in tension forms a liquid-tight seal. For example, the check valve 140 may be fabricated from LDPE or PETG. In response to a force applied on the deformable membrane originating from a single direction, the membrane may deflect along the direction of the applied force. Upon release/ceasing of the applied force, the tension on the membrane may return the membrane to its un-deflected orientation. Thus, the check valve 140 may be in one of two states. As shown in FIG. 2, a first state may be closed and liquid-tight, wherein the check valve 140 does not allow solution from the reservoir 122 to transfer to the well 205. It may be appreciated by those in the art that other one-way valves may be used, for example a spring-ball construction.

Figure 3:
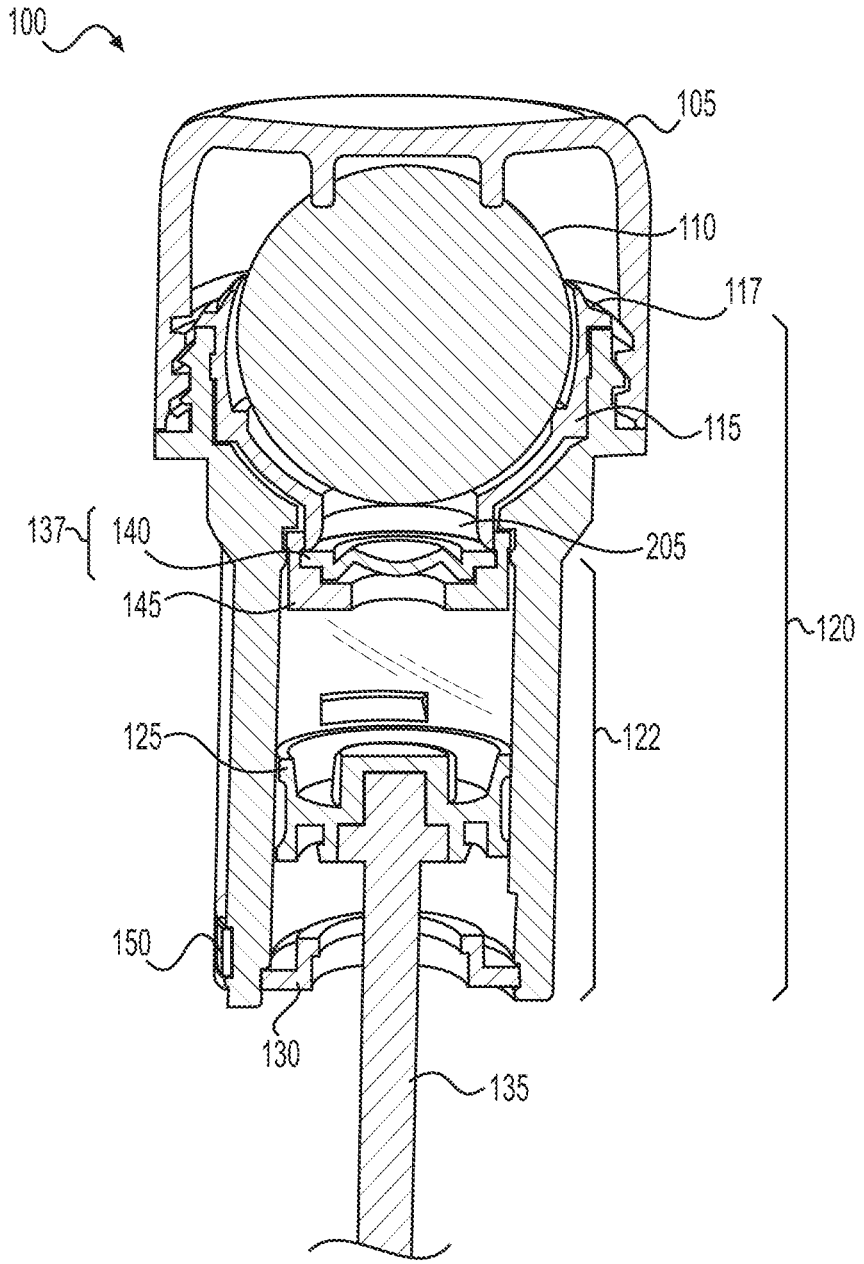
FIG. 3 is a cross-sectional view schematic of a capsule during displacement of a push rod, according to an exemplary aspect of the present disclosure.

FIG. 3 illustrates a cross-sectional view schematic of the capsule 100 during displacement of the push rod 135, according to an exemplary aspect of the present disclosure. A second state of the check valve 140 may be open, wherein the check valve 140 membrane is deflected, thereby breaking the liquid-tight seal and allowing solution to transfer through the check valve 140.

In one aspect, the push rod 135 may be translated a predetermined distance. The push rod 135 may concomitantly translate the piston 125 the predetermined distance in the direction of the first end of the body 120. Since the solution in the reservoir 122 may not be compressible, the force of the piston 125 pushing on the solution may result in the check valve 140 switching from the first (closed) state to the second (open) state. The open check valve 140 may then allow the predetermined volume of solution to transfer from the reservoir 122 to the well 205. The rollerball 110 may be spherical and include a first portion of surface area in contact with the solution that was transferred to the well 205. The rollerball 110 may include a second portion of surface area exposed to the exterior and configured to contact a user's skin. The rollerball 110 may be configured to roll across the user's skin and transfer the predetermined volume of solution, for example the topical medication, from the well 205 to the user's skin. As the rollerball 110 is rotated over the user's skin and deposits the solution onto the user's skin, the second portion of surface area rolls into the well 205 and is coated again with more solution. Notably, the fitment 115 may be fabricated to include some play between the interior of the fitment 115 and the rollerball 110 to allow ease of rolling of the rollerball 110 and facilitate re-coating of the rollerball 110 without the interior of the fitment 115 scraping off said coating of solution as the rollerball 110 rolls.

The predetermined distance the push rod 135 is translated may be determined by calculating the distance needed for the piston 125 to travel in order to displace the predetermined volume of solution in the reservoir 122. The maximum predetermined volume of solution transferred from the reservoir 122 may be determined by calculating the volume of solution the well 205 is capable of holding. The predetermined volume of solution actually transferred from the reservoir 122 to the well 205 may be determined by the metering device, for example the user may be attempting to complete a recommended regimen for treating a skin ailment. Thus, the user may desire a specific dosage of topical medication for applying to the user's skin and the metering device may be configured to transfer the predetermined volume of solution from the reservoir 122 to the well 205 at a predetermined frequency. For example, the metering device may transfer 0.3 mL of solution on a daily basis during a 14-day treatment plan, wherein the metering device is configured to allow the user to apply the solution within a preset length of time, for example 3 minutes per day. An on-board chip (not shown) in the metering device may record the user's usage and a position of the piston 125, wherein upon determining that the position of the piston 125 correlates to a $14^{th}$ day of the treatment, the metering device may notify the user to replace the capsule 100. In response to determining that the user has removed the capsule, the metering device may adjust and reset the position of the piston 125 to a position correlating to a start of the 14-day treatment plan. In addition, the metering device may reset the on-board chip to begin recording the user's usage again anew.

Advantageously, the built-in solution regulating feature, i.e. the check valve 140, may prevent excess solution from transferring to the well 205 once the piston 125 stops and the release of force (and the tension on the check valve 140) closes the check valve 140. Therefore, this prevents the user from over-applying said solution, which is especially important when the solution is a topical medication including a particular active ingredient, for example a drug, which should not be dosed in excess. Additionally, this may be aided by the metering device in which the capsule 100 is installed, wherein the metering device prevents the user from overdosing by only translating the piston 125 via the push rod 135 a predetermined number of instances within a predetermined timeframe, for example once per day, and not more frequently than programmed regardless of user input (e.g. the user prompting the metering device for another dose).

Figure 4:
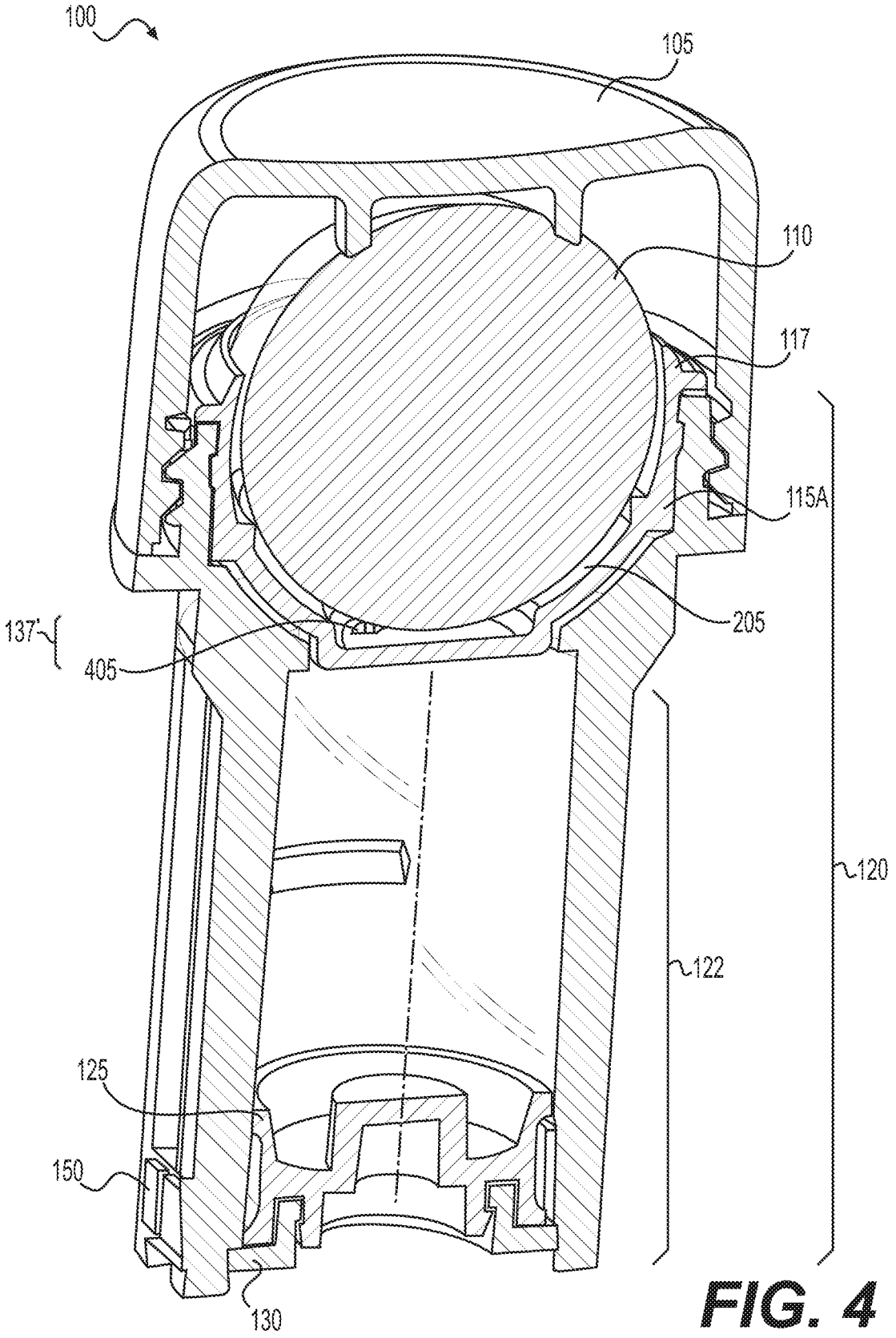
FIG. 4 is a cross-sectional view schematic of a capsule for higher viscosity solutions, according to an exemplary aspect of the present disclosure.

FIG. 4 illustrates a cross-sectional view schematic of the capsule 100 for higher viscosity solutions, according to an exemplary aspect of the present disclosure. In one aspect, a closed fitment 115*a* may be used including a first end and a second end like that of fitment 115. The closed fitment 115*a* may be fabricated similar to fitment 115 and configured for similar functionality, but fabricated such that the solution regulator 137' disposed at the second end of the fitment 115 is substantially closed and the flow metering for the solution regulator 137' is provided by at least one hole 405 (yielding closed fitment 115*a*). The at least one hole 405 may be disposed along the closed portion of the second end of the closed fitment 115*a*. In one aspect, the reservoir 122 may be filled with a high viscosity solution, such as ointment, gel, lotion, paste, or any solution having a viscosity sufficiently high enough to prevent the solution from moving through the at least one hole 405 without the translation of the piston 125. The size of the opening of the at least one hole 405 may be determined by the viscosity of the solution and a surface tension of the solution, wherein the size of the opening may be sufficiently narrow enough to prevent transfer of the solution through the at least one hole 405 due to a vacuum formed between the piston 125 and the interior of the reservoir 122, the viscosity of the solution providing friction forces to reduce flow of the solution, and the surface tension of the solution keeping the solution in the reservoir 122.

Notably, the capsule in this aspect includes a built-in passive solution regulating feature, i.e. the closed fitment 115*a*, that may prevent excess solution from transferring to the well 205 once the piston 125 stops. This again prevents the user from over-applying said solution, which is especially important when the solution is a topical medication including a particular active ingredient, for example a drug, which should not be dosed in excess.

It may be appreciated that the metering device may cause translation of the piston 125 via alternative methods. In an alternative aspect, the piston 125 may be magnetized via fabrication with magnetic materials or inclusion of magnets in or on the piston 125. For example, the piston 125 may be fabricated with polymers impregnated with magnetic metals. For example, a magnet may be attached to the surface of the piston 125. The metering device may include an electromagnet configured to attract or repel the magnetized piston 125. For example, the metering device electromagnet may repel the piston 125 the predetermined distance towards the first end of the body 120 in order to transfer the predetermined volume of solution from the reservoir 122 to the well 205.

In an alternative aspect, the piston 125 and push rod 135 may not be included and the capsule 100 sidewall may be thin and flexible. Instead of translating the push rod 135 the predetermined distance, the metering device may be configured to compress the flexible sidewall the predetermined volume to transfer the solution from the reservoir 122 to the well 205. The metering device may be configured to retain this compression until the user initiates a procedure to remove the capsule 100, wherein the metering device may release the compression to allow removal of the capsule 100.

In one aspect, the authentication chip 150 may be disposed on the surface of the body 120 and configured to communicate with the metering device in order to determine the authenticity of the capsule 100. For example, the metering device may read data on the authentication chip 150 and confirm that the capsule 100 was manufactured by an authorized retailer, such as L'Oréal or an approved L'Oréal subsidiary. The metering device may be configured to prevent usage of the capsule 100 if the authentication chip 150 does not confirm authenticity.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. A system for regulating application of solution to a user, comprising:

a rollerball;

a body, including a first end and a reservoir disposed at a second end of the body;

a fitment, including a well and a solution regulator; and a piston, wherein the fitment is configured to hold the rollerball;

the rollerball is substantially spherical and rotatable in the fitment;

the first end of the body is configured to hold the fitment;

the reservoir is configured to hold a solution;

the piston is inserted into the reservoir at the second end of the body;

the well is configured to receive a predetermined volume of the solution from the reservoir; and the solution regulator includes a check valve attached to the fitment and disposed adjacent to the rollerball on an opposite side of the well, the solution regulator configured to allow transfer of the solution from the reservoir to the well in response to an applied force from a direction of the reservoir and prevent leakage of the solution from the well to the reservoir, the check valve including a deformable membrane held in a liquid-tight, closed state that deforms to an open state in response to the applied force.

2. The system of claim 1, wherein the solution is a topical medication.

3. The system of claim 1, wherein a volume of the well is defined by the space between interior sidewalls of the fitment, the check valve attached to the fitment, and an exterior surface of the rollerball.

4. The system of claim 3, wherein the predetermined volume of the solution transferred through the solution regulator into the well is equal to or less than the volume of the well.

5. The system of claim 3, wherein the volume of the well is greater than 0.2 milliliters.

6. The system of claim 1, wherein the piston is configured to translate a predetermined distance towards the fitment and transfer the predetermined volume of the solution through the solution regulator into the well.

7. The system of claim 1, wherein a translation of the piston towards the fitment generates the applied force to open the check valve to allow transfer of the solution from the reservoir to the well.

8. The system of claim 1, further comprising:

a plug disposed at the second end of the body and proximal to the piston on a side of the piston opposite the first end of the body; and a push rod, wherein the plug is attached to the body and configured to prevent egress of the piston through the second end of the body; and the push rod abuts the piston and translating the piston a predetermined distance towards the fitment is performed by translating the push rod the predetermined distance towards the fitment.

9. The system of claim 8, further comprising:

an authentication chip configured to communicate with a metering device and provide authentication data.

10. The system of claim 1, wherein the fitment is removeably coupled to the first end of the body.

11. The system of claim 10, wherein the fitment is push-fit into the first end of the body.

12. A system for regulating application of solution to a user, comprising:

a rollerball; and a fitment, including a well and a solution regulator, wherein the fitment is configured to hold the rollerball;

the rollerball is substantially spherical and rotatable in the fitment;

the well is configured to receive a predetermined volume of the solution through the solution regulator; and the solution regulator includes a check valve attached to the fitment and disposed adjacent to the rollerball on an opposite side of the well, the solution regulator configured to allow transfer of the solution from a reservoir to the well in response to an applied force from a direction of the reservoir and prevent leakage of the solution from the well to the reservoir, the check valve including a deformable membrane held in a liquid-tight, closed state that deforms to an open state in response to the applied force.

13. The system of claim 12, wherein a volume of the well is defined by the space between interior sidewalls of the fitment, the check valve attached to the fitment, and an exterior surface of the rollerball.

* * * * *